US005747722A

United States Patent [19]

Gladden et al.

[11] Patent Number: 5,747,722

[45] Date of Patent: May 5, 1998

[54] DETONATORS HAVING MULTIPLE-LINE INPUT LEADS

[75] Inventors: Ernest L. Gladden, Granby; Ronald M. Dufrane, North Granby, both of Conn.

[73] Assignee: The Ensign-Bickford Company, Simsbury, Conn.

[21] Appl. No.: 548,815

[22] Filed: Jan. 11, 1996

[51] Int. Cl.[6] ..... C06C 5/06; C06C 5/00

[52] U.S. Cl. ..... 102/275.11; 102/275.5; 102/275.7; 102/275.9

[58] Field of Search ..... 102/275.1, 275.2, 102/275.3, 275.4, 275.5, 275.6, 275.7, 275.8, 275.9, 275.11, 275.12, 318, 322

[56] References Cited

U.S. PATENT DOCUMENTS

| | | | |
|---|---|---|---|
| 305,223 | 9/1884 | Powell . | |
| 309,095 | 12/1884 | Reese . | |
| 1,025,065 | 4/1912 | Ingram | 102/275.9 |
| 1,827,032 | 10/1931 | McCurdy . | |
| 1,837,398 | 12/1931 | Beatty | 102/275.9 |
| 2,775,200 | 12/1956 | Guenter . | |
| 2,923,239 | 2/1960 | Andrew et al. . | |
| 2,952,206 | 9/1960 | Becksted . | |
| 3,021,785 | 2/1962 | Hradel et al. . | |
| 3,162,122 | 12/1964 | Gurton et al. | 102/275.11 |
| 3,389,659 | 6/1968 | Cassidy et al. . | |
| 3,437,037 | 4/1969 | Newman . | |
| 3,589,292 | 6/1971 | Hanson et al. | 102/275.9 |
| 3,590,739 | 7/1971 | Persson . | |
| 3,614,928 | 10/1971 | Partridge et al. . | |
| 3,793,954 | 2/1974 | Johnston . | |
| 3,885,499 | 5/1975 | Hurley . | |
| 3,939,772 | 2/1976 | Zebree . | |
| 3,981,240 | 9/1976 | Gladden . | |
| 3,987,732 | 10/1976 | Spraggs et al. . | |
| 4,073,235 | 2/1978 | Hopler, Jr. . | |
| 4,328,753 | 5/1982 | Kristensen et al. . | |
| 4,426,933 | 1/1984 | Yunan . | |
| 4,429,632 | 2/1984 | Yunan . | |
| 4,485,741 | 12/1984 | Moore et al. . | |
| 4,527,482 | 7/1985 | Haynes . | |
| 4,607,573 | 8/1986 | Thureson et al. . | |
| 4,757,764 | 7/1988 | Thureson et al. . | |
| 4,815,382 | 3/1989 | Yunan . | |
| 4,911,076 | 3/1990 | Rowe . | |
| 5,070,789 | 12/1991 | True et al. . | |
| 5,171,935 | 12/1992 | Michna et al. . | |
| 5,173,569 | 12/1992 | Pallanck et al. . | |
| 5,204,492 | 4/1993 | Jacob et al. . | |
| 5,277,120 | 1/1994 | Campoli et al. | 192/275.1 |
| 5,377,592 | 1/1995 | Rode et al. . | |
| 5,398,611 | 3/1995 | Michna et al. . | |
| 5,435,248 | 7/1995 | Rode et al. . | |
| 5,597,973 | 1/1997 | Gladden et al. | 102/275.8 |
| 5,661,256 | 8/1997 | Sutula, Jr. et al. | 102/275.4 |

FOREIGN PATENT DOCUMENTS

| | | | |
|---|---|---|---|
| 0500512 | 8/1992 | European Pat. Off. . | |
| 478 | 8/1879 | United Kingdom | 102/275.1 |

*Primary Examiner*—Michael J. Carone
*Assistant Examiner*—Theresa M. Wesson
*Attorney, Agent, or Firm*—Law Office of Victor E. Libert; Victor E. Libert; Frederick A. Spaeth

[57] ABSTRACT

A detonator (10) is equipped with an input lead (29) having multiple signal transmission lines (30, 31) which provide redundant initiation signals to the target charge (14) of a detonator (10, 10') thereby increasing the reliability of initiation. The multiple signal transmission lines (30, 31) may be made of shock tube and can be part of a long or short input lead (29, 129) and may be initiated by any suitable means, for example by being disposed in signal transmission relation to a detonating cord (60, 62) to improve the reliability with which a signal is transferred from the detonating cord (60, 62) to the detonator (10, 10').

13 Claims, 6 Drawing Sheets

FIG. 1
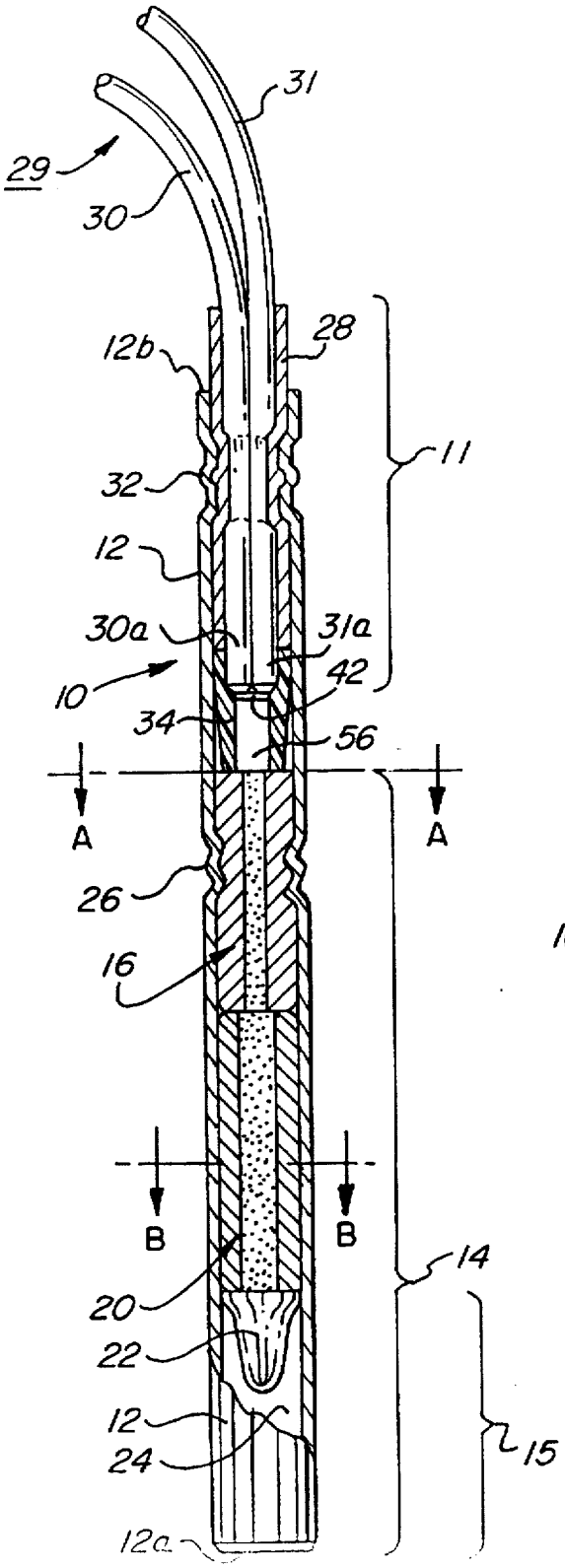
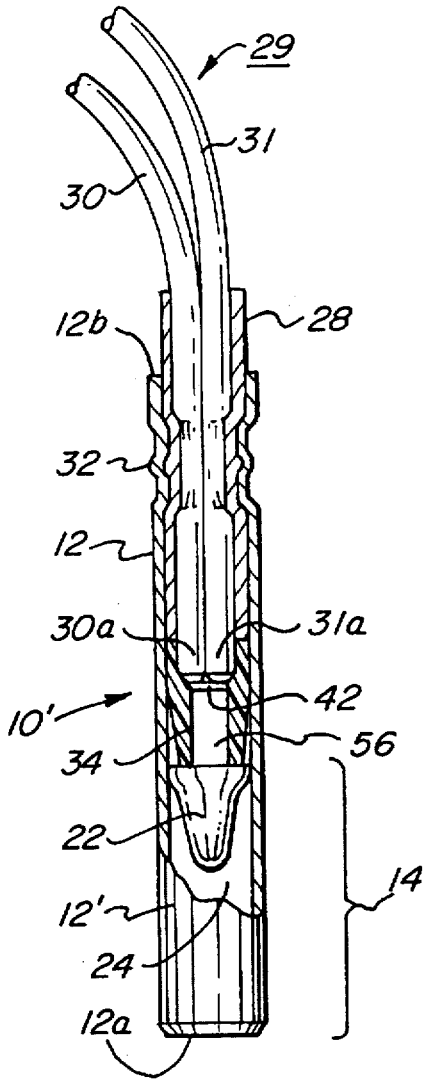
FIG. 1C

DETONATORS HAVING MULTIPLE-LINE INPUT LEADS

BACKGROUND OF THE INVENTION

1. Field of the Invention

The present invention relates to non-electric detonators for use in transmitting explosive initiation signals and, in particular, to detonators having multiple-line input leads.

2. Related Art

Detonators are used as signal amplifiers to transfer initiation signals from one kind of line to another or to initiate various types of explosive charges, one specific example being to initiate boosters for downhole explosive charges in blasting operations. A conventional detonator comprises an elongated shell having one closed end and one open end. An explosive output charge is disposed in the closed end of the shell, and a delay element may also be disposed in the shell between the open end and the output charge. The output charge and the optional delay element may collectively be referred to as a target charge. A single input line, which may be a length of low energy detonating cord, low velocity signal tube, or shock tube, is passed through the open end of the shell and secured therewithin with the enclosed end of the input line disposed within the detonator adjacent to the target charge, so that when the line is fired the initiation signal is transferred from the enclosed end to the target charge.

U.S. Pat. No. 4,911,076 to Rowe, dated Mar. 27, 1990, discloses a delay detonator having two shock tube lines having their ends disposed in signal transmission relation to the delay element of the detonator. Either of the lines can be used as a signal input line to initiate the delay element and then the explosive output charge of the detonator. After the designated delay, the detonator output charge is initiated, thereby initiating an output signal in the other shock tube line. Because the ends of both shock tube lines are disposed in signal transmission relation to the delay element, an input signal emitted from either line will initiate the delay element and then the output charge. However, Rowe requires that the signal-emitting ends of both lines are sealed so that when the one line selected as the input line ignites the delay element, the other line will not have a premature output signal initiated therein but the output signal will be initiated only by initiation of the output explosive charge after the delay period has expired.

U.S. Pat. No. 3,885,499, issued May 27, 1975 to Hurley, U.S. Pat. No. 3,939,772, issued Feb. 24, 1976 to Zebree, and U.S. Pat. No. 4,073,235, issued Feb. 14, 1978 to Hopler, Jr., each concerns non-electrically initiated blasting caps, i.e., detonators, which show two tubes entering the shell of the detonator. In each case, one tube transmits an explosive gas mixture into the detonator shell and the other provides a conduit exiting the detonator shell for transmitting the explosive gas mixture or a purge gas outwardly of the detonator shell. The detonators of these three patents are initiated by initiation of the explosive gas mixture and the paired tubes connected to each shell serve as conduits for passage of the explosive gas mixture through the detonators thence, e.g., to downstream detonators.

U.S. Pat. No. 4,485,714 to Moore et al, dated Dec. 4, 1984, discloses a detonator and booster apparatus in which the detonator is initiated via a signal transmission tube that picks up an initiation signal from a detonating cord downline. In the embodiment of FIG. 2C, the signal transmission tube is looped around a small section of the detonating cord where the two are tied in a knot. In the embodiment of FIG. 2D, the end of the signal transmission tube is looped around the detonating cord and a significant portion of the signal transmission tube is disposed in close parallel relation with the detonating cord.

Moore et al is typical of the well-known expedient in the art of blasting to convey initiation signals from detonating cords to signal transmission tubes such as shock tubes by disposing the detonating cord in signal transmission relation with the shock tube and firing the cord.

SUMMARY OF THE INVENTION

In accordance with the present invention there is provided a detonator having an output section and comprising the following components. A shell defines an enclosure and has disposed within it at the output section thereof a target charge comprising at least an explosive output charge. An input lead, for example, one made of shock tube, extends into the detonator and is secured therewithin, the input lead having at least two signal transmission input lines extending into the shell and terminating in signal-emitting ends disposed within the shell in signal transmission relation with the target charge.

In one aspect of the present invention, the input lead comprises one or more, e.g., two, looped input line segments, each comprising a bight portion connecting two legs extending into the shell and terminating in the signal-emitting ends.

In another embodiment of the present invention, the input lead may comprise at least two separate signal transmission strand lines, each line having opposite first and second ends with the signal-emitting first end of each strand line being disposed within the shell in signal transmission relation with the target charge, and the second end of each strand line being disposed exteriorly of the shell.

In one embodiment of the invention, the target charge further comprises a delay element connecting the input lead and the explosive output charge in initiation signal communication, e.g., the delay element is interposed between the input lead and the explosive output charge.

In a particular aspect of the present invention, the detonator has an input section and the shell has a closed end at the output section of the detonator and an open end which is sealed by a sealant means and is located at the input section of the detonator. In this embodiment, the signal transmission input lines extend into the shell through the open end thereof.

Another aspect of the present invention provides a method of initiating a detonator having disposed therein a target charge comprising at least an explosive output charge dimensioned and configured to be initiated by an input signal transmitted thereto by a plurality of signal transmission lines having signal-emitting ends disposed in signal transmission communication with the target charge, the method comprising transmitting, e.g., substantially simultaneously transmitting, at least two initiation signals to the target charge.

In another method aspect of the invention, the method further comprises transmitting at least four initiation signals to the target charge.

Yet another aspect of the present invention provides that the target charge further comprises a delay element having a selected delay period and interposed between the signal-emitting ends of the signal transmission input lines and the output charge, and the method comprises transmitting the initiation signals to the delay element and via the delay element to the output charge. In this way, travel of the initiation signals between the signal-emitting ends of the input lines and the output charge is delayed by the selected delay period.

Other aspects of the invention are disclosed in the following description and drawings.

As used herein and in the claims, the term "input line" as used in relation to a detonator refers to a length of signal transmission line that has an end secured in the detonator, for carrying an initiation signal to the detonator.

The term "strand" as used in relation to a detonator input lead indicates an input line having two ends with only one end secured in the detonator.

The terms "looped input line segment", "looped input lead" and "eyelet lead" refer to a segment of signal transmission line having two ends, both of which are secured in the detonator. A looped input line segment thus provides two input lines for the detonator.

The term "input lead" refers collectively to all the input lines of a detonator.

BRIEF DESCRIPTION OF THE DRAWINGS

FIG. 1 is a side elevation view, with parts broken away, of a delay detonator, in accordance with one embodiment of the present invention;

FIG. 1C is a view similar to that of FIG. 1 of an instantaneous-acting detonator in accordance with another embodiment of the present invention;

DETAILED DESCRIPTION OF THE INVENTION AND PREFERRED EMBODIMENTS THEREOF

Figure 1B:
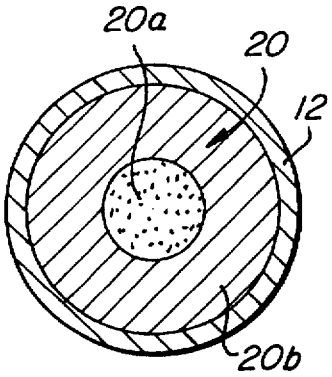
FIGS. 1A and 1B are cross-sectional views, enlarged with respect to FIG. 1, taken along, respectively, lines A—A and B—B of FIG. 1.

The present invention relates to detonators having improved initiation reliability. As indicated above, conventional detonators have an input lead comprising a single signal transmission input line that carries an initiation signal from a donor device to the detonator, specifically, to a target charge contained within the detonator. The donor line may be any suitable device such as a spark igniter (in which case the input lead must be a shock tube), another detonator, detonating cord or the like. The target charge, in the case of an instantaneous-acting detonator, comprises the explosive output charge which conventionally includes a primary explosive such as lead azide and a secondary explosive such as PETN. In the case of delay detonators, the target charge comprises a delay element, either the well-known pyrotechnic delay element or an electronic delay element such as briefly described below. In accordance with the present invention, a detonator is equipped with an input lead comprising at least two input lines by which a plurality of preferably simultaneous or substantially simultaneous initiation signals are transmitted to the target charge of the detonator. The resulting redundancy in carrying an initiation signal to the detonator improves reliability because a failure of one of the lines to function properly is not fatal as only one of the plurality of initiation signals need reach the target charge. Therefore, reliance on a single input line to initiate the detonator is avoided.

The present invention may be realized by providing a detonator with an input lead comprising a plurality of, i.e., at least two, signal transmission input lines which extend into the open end of the detonator shell and terminate in signal-emitting ends which are disposed in signal transmission relation with the target charge within the detonator. For example, the input lead may comprise one or more looped input line segments each having a bight portion connecting two leg portions with the ends of both leg portions secured within the detonator, thus providing two input lines. Alternatively, the input lead may comprise at least two separate strands of signal transmission line, each strand having opposite ends and having one end (the signal-emitting end) secured within the detonator and the other end sealed off at a point remote from the detonator. Preferably, the input lines comprise lengths of shock tube having an outside diameter (OD) not greater than about 2.380 mm (0.0937 inch), for example, a tube outside diameter (OD) of from about 0.397 to 2.380 mm (about 0.0156 to 0.0937 inch), and the ratio of the inside diameter of the tube to the radial thickness of the tube wall is from about 0.18 to 2.5. The inside diameter of the tube may be from about 0.198 to 1.321 mm (about 0.0078 to 0.0520 inch). The powder surface density of the reactive material contained within the bore of the tube may, but need not, be significantly less than that which the prior art considers to be minimum, acceptable powder surface density. Such shock tube is described in co-pending patent application Ser. No. 08/380,839, now U.S. Pat. No. 5,599,973, filed Jan. 30, 1995 in the name of E.L. Gladden et al for "Improved Signal Transmission Fuse"

Referring now to FIG. 1, an embodiment of a delay detonator in accordance with the present invention is generally indicated at 10 and comprises an elongate tubular casing or shell 12 made of a suitable plastic or metal, such as a semi-conductive plastic material or, as in the illustrated embodiment, a metal such as aluminum or copper. Detonator 10 has an input section 11 and an output section 15 and shell 12 has a closed end **12*a* defining the end of the output section 15 and an opposite, open end 12*b* at the entry to the input section 11. At closed end 12*a*, shell 12 is configured as a continuous wall. The open end 12*b* is open to provide access of components to the interior of shell 12 and is eventually sealed by bushing 28 and crimp 32 as described below. In the illustrated embodiment, an input lead 29 is comprised of two signal transmission input lines 30, 31 each terminating in a respective signal-emitting end 30***a*, 31*a*. Input lead 29 is secured within shell 12 as more fully described below.

A target charge generally indicated at 14 is disposed within shell 12 and is comprised of a pyrotechnic delay element comprising a sealer member 16 and a delay member 20 and an explosive output charge comprised of primary and secondary charges 22, 24, all connected in series and terminating at the closed end 12*a* of detonator 10. The explosive output charge 22, 24 is disposed within, and in fact defines, the output section 15. Primary explosive charge 22 may comprise any suitable primary explosive, e.g., lead azide or DDNP (diazodinitrophenol), and secondary explosive charge 24 may comprise any suitable secondary explosive, e.g., PETN. As those skilled in the art will appreciate, target charge 14 may include more or fewer elements than those illustrated in FIG. 1. Thus, sealer member 16 and delay member 20 may be eliminated so that target charge 14 comprises only one or more explosive charges, such as primary and secondary charges 22, 24 to provide an instantaneous-acting detonator. Such an instantaneous-acting detonator 10' is illustrated in FIG. 1C wherein it is seen to be identical to delay detonator 10 except that the delay element (sealer member 16 and delay member 20) has been omitted and shell 12' consequently is shorter in length than shell 12 of the FIG. 1 embodiment. The other components of instantaneous-acting detonator 10' are identical to those of delay detonator 10, are numbered identically thereto and therefore need not be described with respect to their structure. Generally, any known type of detonator construction may be used in connection with the invention, including those supplied with electronic delay elements. Such electronic delay elements may be used in conjunction with any suitable type of input lead, for example, one made of shock tube or deflagrating tube, which is used to transmit a non-electric, e.g., an impulse signal (which may be amplified or generated by a small amplifier explosive charge within the detonator shell) to generate an electrical signal by imposing the (optionally amplified) impulse signal upon a piezoelectric generator. The resulting electrical signal is transmitted to an electronic circuit which includes a counter to provide a timed delay after which a capacitor circuit is triggered to initiate the output explosive charge. Such electronic delay elements and detonators including the same are disclosed and claimed in U.S. Pat. No. 5,377,592,"Impulse Delay Unit", issued on Jan. 3, 1995 to K.A. Rode et al, and U.S. Pat. No. 5,435,248, "Extended Range Digital Delay Detonator", issued on Jul. 25, 1995 to R.G. Pallanck et al. The disclosures of these patents are hereby incorporated by reference herein. Accordingly, target charge 14 may provide in delay detonators either a pyrotechnic or an electronic delay element as the immediate target of the signal transmitted by input lead 29, or target charge 14 may provide, in instantaneous-acting detonators, an explosive charge as the immediate target.

Figure 1A:
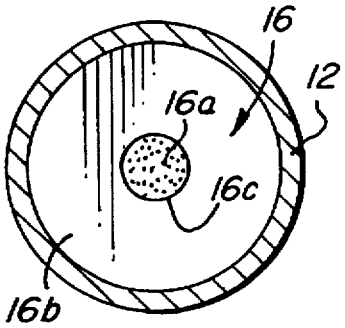

As shown in FIGS. 1A and 1B, the sealer and delay members 16, 20 of target charge 14 each comprises respective pyrotechnic cores 16*a* and 20*a* encased within suitable respective sheaths 16*b* and 20*b*. The sheaths 16*b* and 20*b* conventionally comprise a material that may readily be deformed by pressure or crimping, such as lead or pewter or a suitable polymeric material ("plastic"). Thus, a crimp 26 may be formed in shell 12 to slightly deform sheath 16*b*, thereby securely sealing and retaining target charge 14 positioned within shell 12. Alternatively, the sheath 16*b* may be pressed longitudinally within the shell 12 to expand and seal the sheath against the inside wall of the shell or the sheath may be sized to provide an interference fit within shell 12.

Target charge 14 occupies only a portion of the length of shell 12, and is disposed adjacent the closed end 12*a* thereof. The open end 12*b* of shell 12 is fitted with a sealant means which, in the illustrated embodiment, comprises a retainer bushing 28. Open end 12*b* receives therein the end portions of signal transmission lines 30, 31 which terminate is signal-emitting ends 30*a*, 31*a*. The signal-emitting ends 30*a*, 31*a* are disposed within shell 12 and along with the associated end portions of lines 30, 31 are retained within shell 12 by a second crimp 32 formed at or in the vicinity of open end 12*b* of shell 12 about retainer bushing 28 to grip the latter and the end portions of lines 30, 31 in place, and to seal the interior of shell 12 against the environment. Accordingly, retainer bushing 28 is usually made of a resilient material such as a suitable rubber or elastomeric polymer. As previously noted, lines 30, 31 may be any suitable signal transmission lines such as low velocity (deflagrating) signal transmission tubes or low energy detonating cord or shock tube and, in the illustrated embodiment, comprise shock tubes. As is well known, shock tube comprises either a laminated tube or a monotube. A laminated tube typically has an outer tube which may be made of polyethylene, extruded over, or co-extruded with, a sub-tube which may be made of a polymer, such as a SURLYN™ ionomer, to which a coating of a reactive powder, e.g., a mixture of powdered aluminum and a pulverulent explosive such as HMX (cyclotetramethylene tetranitramine) adheres. A dusting of the reactive powder clings to the inner wall provided by the inside surface of the shock tube.

Isolation member 34 is interposed between the signal-emitting ends 30*a*, 31*a* of input lines 30, 31 and the input end of the target charge 14 which, in the embodiment of FIG. 1, is the end of sealer member 16 which faces the open end 12*b* of shell 12. As is well-known in the art, isolation member 34 is made from a semi-conductive material, so any static electricity that builds up in the shock tubes comprising lines 30, 31 is shunted to the shell 12 by isolation member 34, and is thus diverted away from the target charge 14 to prevent inadvertent detonations. It should be understood that although the input leads illustrated in FIGS. 2A–4 and FIGS. 5B and 5C are short input leads, input lead 29 may be quite long, as much as one hundred meters or so. Isolation member 34 has a generally cylindrical body that defines a central bore having an input end for engaging the signal-emitting ends 30*a*, 31*a*, and a discharge port 56 at its opposite end, the discharge port 56 being separated from the input end of isolation member 34 by a rupturable membrane 42. Initiation signals emitted by the signal-emitting ends 30*a*, 31*a* rupture membrane 42 and pass through discharge port 56 to initiate target charge 14. In the case of the illustrated embodiment, this occurs by initiating the sealer member 16 which in turn initiates delay member 20 then explosive charges 22, 24.

In a conventional detonator, the signal-emitting end of but a single signal transmission line input lead is disposed at the input end of the central bore of isolation member 34. In contrast, in accordance with the present invention, the input end of isolation member 34 engages the signal-emitting ends of two or more signal transmission input lines, any one of which suffices to initiate the target charge 14. Because none of the signal transmission input lines are used to carry an output signal from the detonator, it is not only not necessary to close the signal-emitting ends 30*a*, 31*a* of the input lines as in the above-mentioned Rowe U.S. Pat. No. 4,911,076, but it would be counterproductive to the purposes of the present invention to do so. Leaving the signal-emitting ends 30*a*, 31*a* open provides a higher signal strength to impinge upon the target charge 14 as no signal strength need be expended in breaking through a sealed end as is required in the Rowe Patent. Having two or more signal transmission input lines further increases the reliability of detonator 10 by providing redundant input signals.

Figure 2A:
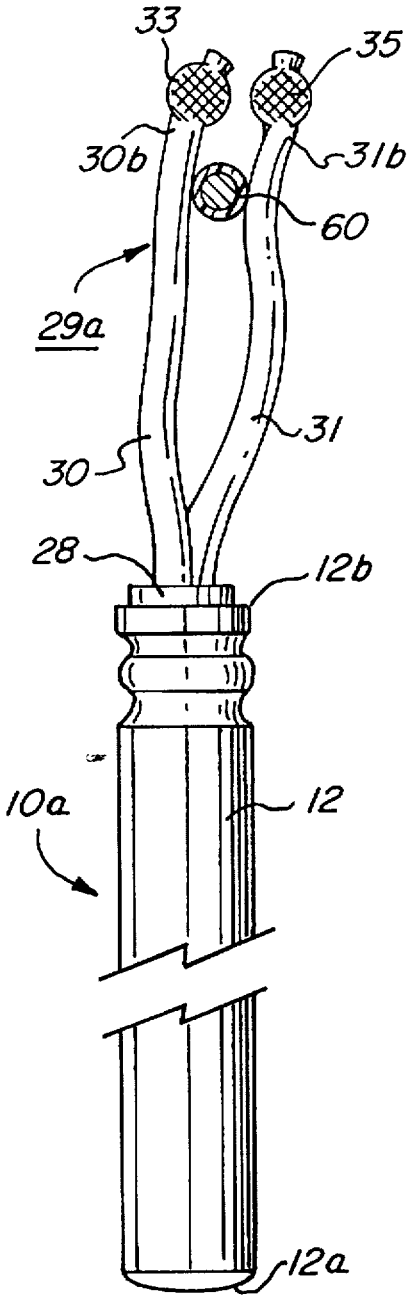
FIGS. 2A and 2B are side elevation views of alternate embodiments of a two-input line detonator in accordance with the present invention, showing in cross section a detonating cord disposed in signal transmission relation with the input lead.
Figure 2B:
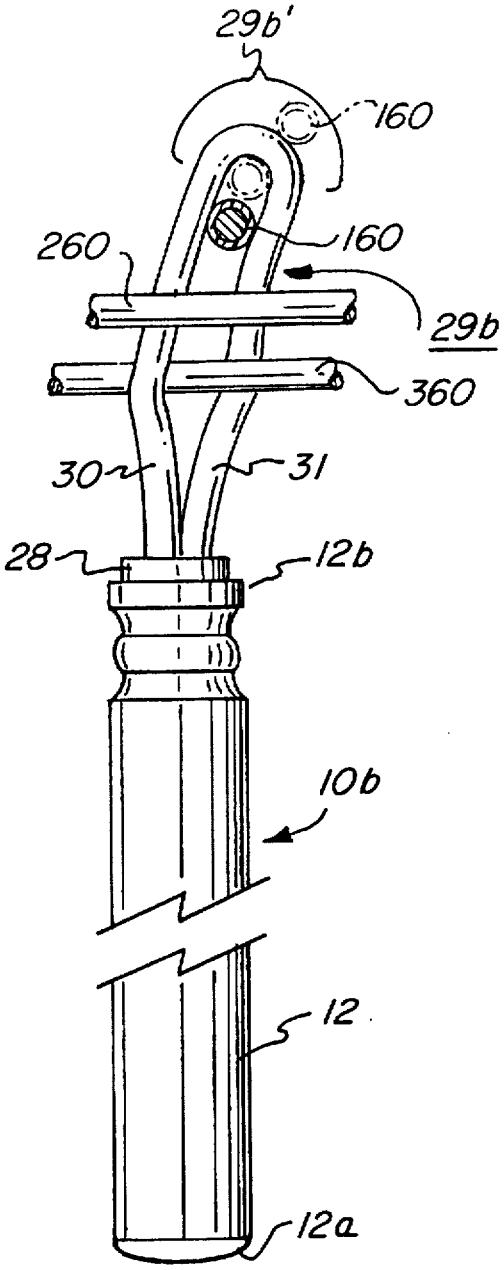

FIGS. 2A and 2B illustrate alternate embodiments of short input lead detonators in accordance with the present invention. In detonator 10*a* of FIG. 2A, input lead 29*a* is comprised of signal transmission input lines 30 and 31, each comprising separate segments or strands of shock tube, each segment having two ends. One end of each shock tube strand is a signal-emitting end, not visible in FIGS. 2A or 2B, but corresponding to signal-emitting ends 30*a* and 31*a* of FIGS. 1 and 1C. The input lines 30, 31 extend outwardly from the open end 12*b* of shell 12 of detonator 10*a* for a suitable distance and terminate in distal ends 30*b*, 31*b*, respectively. Distal ends 30*b*, 31*b* are sealed off by seals 33, 35 so that the hollow interior of the shock tube is not exposed to the environment. Since shock tube is conventionally made from thermoplastic polymeric materials, sonic welding or any other suitable method may be used for sealing the distal ends 30*b*, 31*b*. Both input lines 30 and 31 are disposed in signal transmission relation to a signal donor line such as detonating cord 60, shown in cross section in FIGS. 2A and 2B. Thus, when the donor line initiates, initiation signals are ignited in both input lines 30 and 31, so that detonator 10*a* receives two substantially simultaneous initiation signals to ignite its target charge, not visible in FIGS. 2A or 2B, but analogous to target charge 14 of FIGS. 1 and 1C.

In the embodiment shown in FIG. 2B, input lead (or "eyelet lead") 29*b* is comprised of signal transmission input lines 30 and 31 which comprise opposite legs or ends of a segment of line bent upon itself in a loop to provide a bight portion 29*b*' connecting the legs which provide input lines 30 and 31 in this embodiment. Alternatively, the looped input lead can be attained by sealing together the distal ends (30*b*, 31*b* of FIG. 2A) of two separate signal transmission lines (such as 30, 31 of FIG. 2A) so that the distal ends are secured together, e.g., within a sealant cap (not shown). The donor line, i.e., detonating cord 160, can be passed through the loop defined by input lead 29*b* and, as illustrated in FIG. 2B, may be disposed inside the loop so that it has two points of contact with input lead 29*b* to initiate input signals on the inside of the loop of input lead 29*b* simultaneously at two points. This enhances the reliability of transferring a signal from detonating cord 60 or 160 to input lead 29*a* or 29*b* because even if signal transfer fails at one of the contact points it may well succeed at another. If the detonating cord is positioned against the inside curve of bight portion 29*b*' as illustrated by detonating cord 160 in FIG. 2B, conforming contact is attained between about one-half the periphery of detonating cord 160 and input lead 29*b*. Providing such conforming contact is another way to improve signal transfer from the detonating cord to the input lead. Further, whether (a) the detonating cord is positioned outside the looped input lead (as shown in dash line at 160 in FIG. 2B) so that it initiates a signal at only one point in the loop, or (b) if only one of the contact points attained with detonating cord 160 inside the loop is initiated by detonating cord 160, or (c) if conforming contact is established between the detonating cord and the looped input line segment, detonator 10*b* will still receive two initiation signals because the signal initiated in looped input lead 29*b* will travel in both directions from the point of initiation and then via signal transmission lines 30, 31 to be emitted at both signal-emitting ends thereof (not shown in FIG. 2B). Thus, the same input signal redundancy is achieved in the embodiment of FIG. 2B with one successful initiation as is achieved in the embodiment of FIG. 2A with two successful initiations. For this reason, the looped embodiment of FIG. 2B is preferred over the multiple strand embodiment of FIG. 2A. Another reason for this preference is that since both ends of the legs of looped input lead 29*b* are secured in detonator 10*b*, there is no need for the extra step of sealing the distal ends of the shock tube signal transmission lines, as must be done for the embodiment of FIG. 2A. In addition, securing the two ends of a shock tube segment in the input end of the detonator provides a better barrier against penetration of the tube by oil, water, and other environmental contaminants than sealing the distal end of a strand-type input line. In tests by the applicants, detonators having only looped input leads and detonators having strand input leads were immersed in oil for 16 hours at 175° F. and about 12 hours at 160° F., respectively. The detonators were then tested, and the detonators having looped input leads detonated more reliably than the detonators having strand-type input leads. This shows that a detonator with a looped segment input lead may be preferred if the detonator will be exposed to external contaminants for extended periods of time, i.e., if the detonator will be required to "sleep" while being exposed to contaminants such as oil prior to initiation.

It should also be noted that multiple contact points can be attained with detonating cord positioned outside the loop of input lead 29*b* as illustrated in FIG. 2B by positioning the detonating cord as shown for detonating cord 260 which is maintained in contact with each of signal transmission lines 30, 31. Alternatively, a detonating cord 360 could be threaded through the eyelet loop to similarly maintain a contact area with each of signal transmission lines 30, 31.

Figure 5:
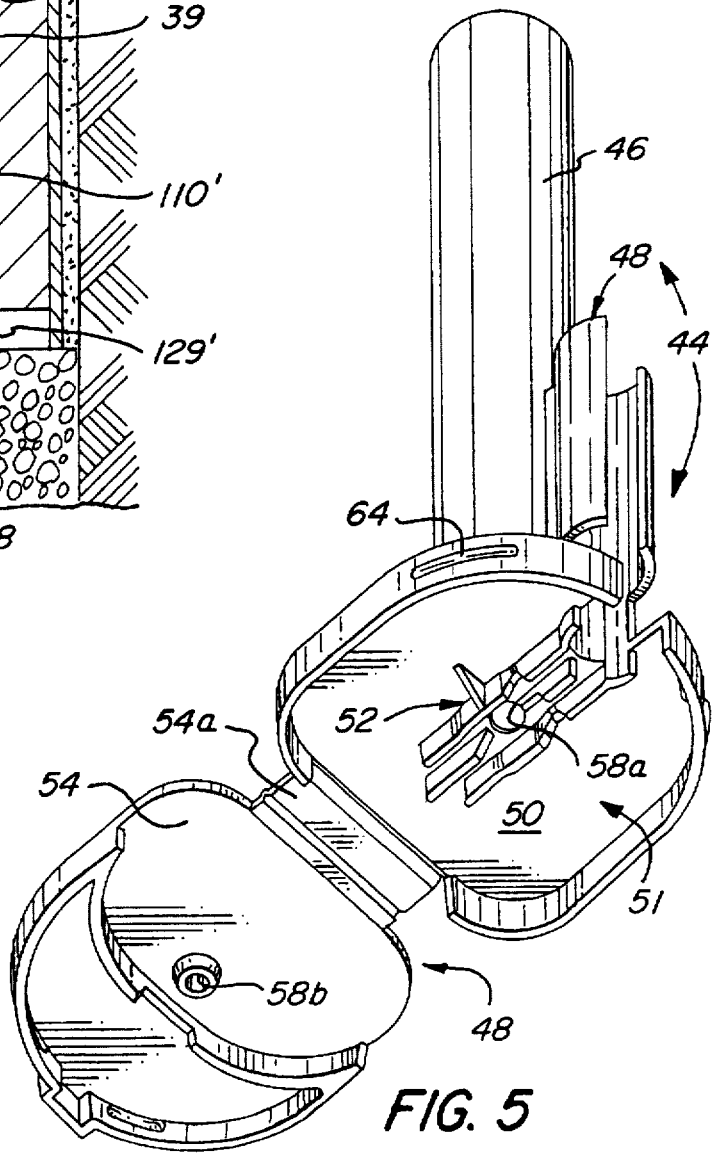
FIG. 5 is a perspective view of a slider unit useful for retaining a detonator, in accordance with the present invention, in place in a booster charge.

The relationship between the detonating cord and the input lead is maintained by any suitable means, a preferred version of which is described below in connection with FIGS. 5–5C which illustrates the use of the multiple-line input leads of the invention in conjunction with the slider unit of a booster charge.

Figure 3A:
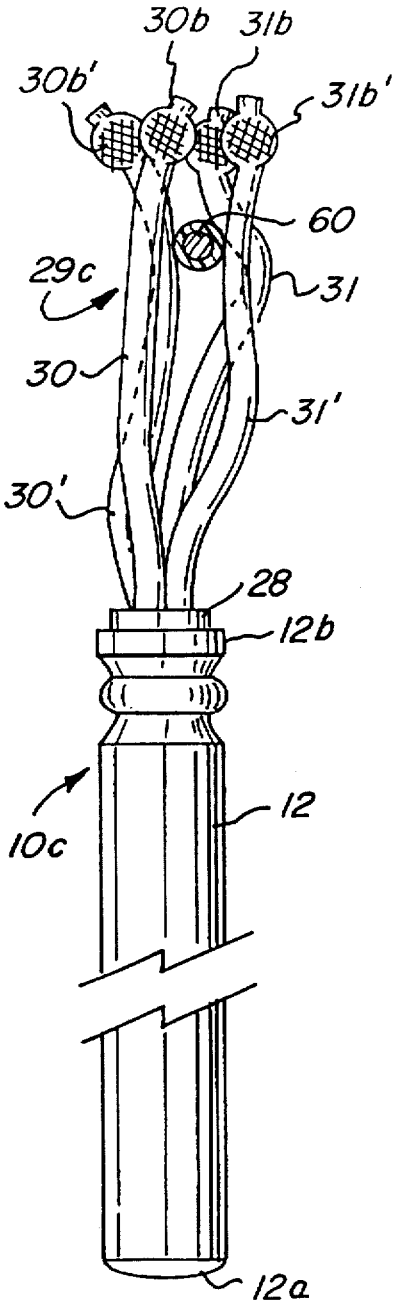
FIGS. 3A, 3B and 3C are side elevation views of three alternate embodiments of detonators according to the present invention and showing in FIGS. 3A and 3B cross-sectional views of detonating cord disposed in signal transmission relation with the input leads.
Figure 3B:
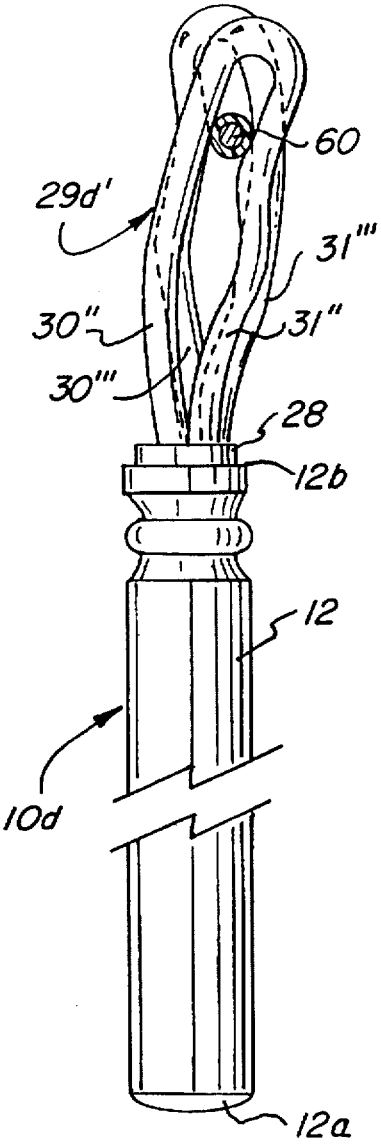
Figure 3C:
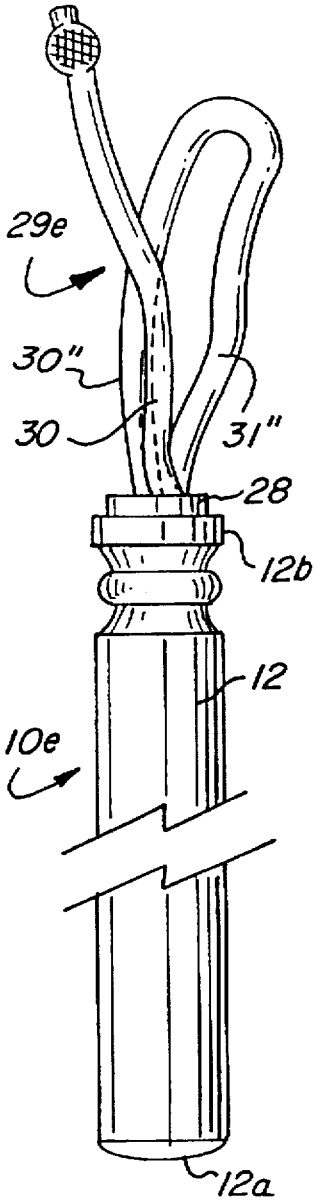

FIGS. 3A, 3B and 3C illustrate other embodiments of the invention comprising, respectively, detonators 10*c*, 10*d* and 10*e*, in each of which the input leads are comprised of shock tube. In FIG. 3A, input lead 29*c* is comprised of signal transmission input lines 30, 30', 31, 31' for a total of four separate signal transmission lines comprising four separate strands of shock tube, each having a signal-emitting end (not seen in FIGS. 3A–3C but analogous to signal-emitting ends 30*a*, 31*a* of FIGS. 1 and 1C) secured in the detonator and a distal, sealed end 30*b*, 30*b*', 31*b*, 31*b*'. The embodiment of FIG. 3B has an input lead 29*d*' which also has four signal transmission lines, but these are provided by two looped segments one of which provides signal transmission input lines 30", 31"; the other of which provides signal transmission input lines 30'", 31'". FIG. 3C has an input lead 29*e* having three signal transmission lines provided in this case by a single strand input line 30 and a looped input line segment that provides input lines 30" and 31". The embodiment of FIG. 3C accordingly illustrates that a strand-type input line and a looped input line segment may be used in the same detonator. The other portions of the embodiments of FIGS. 2A, 2B and 3A–3C are identical or similar to the embodiments of FIGS. 1 and 1C and are identically numbered thereto and not further described herein.

Figure 4:
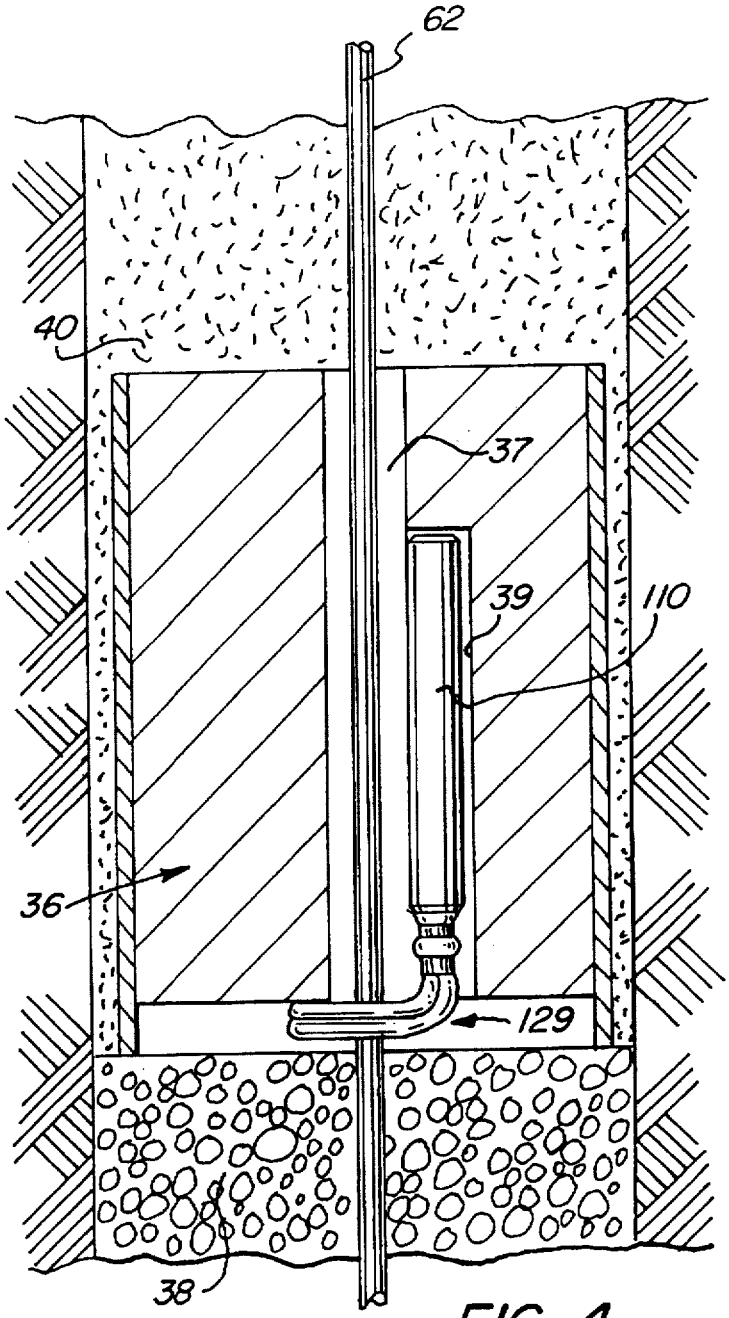
FIG. 4 is a schematic cross-sectional view of a booster charge within which a detonator according to one embodiment of the present invention is disposed.

FIG. 4 provides a schematic illustration of a typical environment of use of a multiple input detonator in accordance with the present invention. FIG. 4 shows a booster charge 36 resting upon a layer of stemming material 38 in a borehole (unnumbered). Booster charge 36 may have any suitable shape but is shown as a simple, constant circular cross-sectional cylindrical configuration, and has a downline well 37 and a detonator well 39 formed therein. A downhole line of detonating cord 62 passes through a borehole charge 40 which is typically an ANFO (ammonium nitrate-fuel oil) or other suitable (e.g., emulsion) charge, then through booster charge 36 via a downline well 37, then through stemming material 38 and, in the multiple deck arrangement illustrated, onward down the borehole to the next booster charge (not shown). The bottom portion of booster charge 36 is dimensioned and configured to receive a slider unit (omitted from FIG. 4 for clarity of illustration but described below) that holds a detonator 110 which has an input lead 12*a* that comprises four signal transmission lines provided by two looped input line segments made of shock tube. Input lead 129 is disposed in signal transmission relation to detonating cord 62, which is passed through the inside of both loops of input lead 129. A suitable slider unit, such as that shown in FIG. 5, may be used to retain detonator 110 within detonator well 39. As described below, the slider unit may also provide a shielding tube (e.g., shielding tube 46, FIG. 5) to protect detonator 110, booster charge 36 and its downline well 37 from damage by the explosive force of detonating cord 62. If booster charge 36 or its downline well 37 are damaged by detonation of detonating cord 62, reliability of initiation by detonator 110 will be adversely effected. This and other benefits of slider unit 44 are described in detail in copending patent application Ser. No. 08/548,813, filed on Jan. 11, 1996 in the name of Daniel P. Sutula, Jr. et al for "Method and Apparatus for Transfer of Initiation Signals".

Figure 4A:
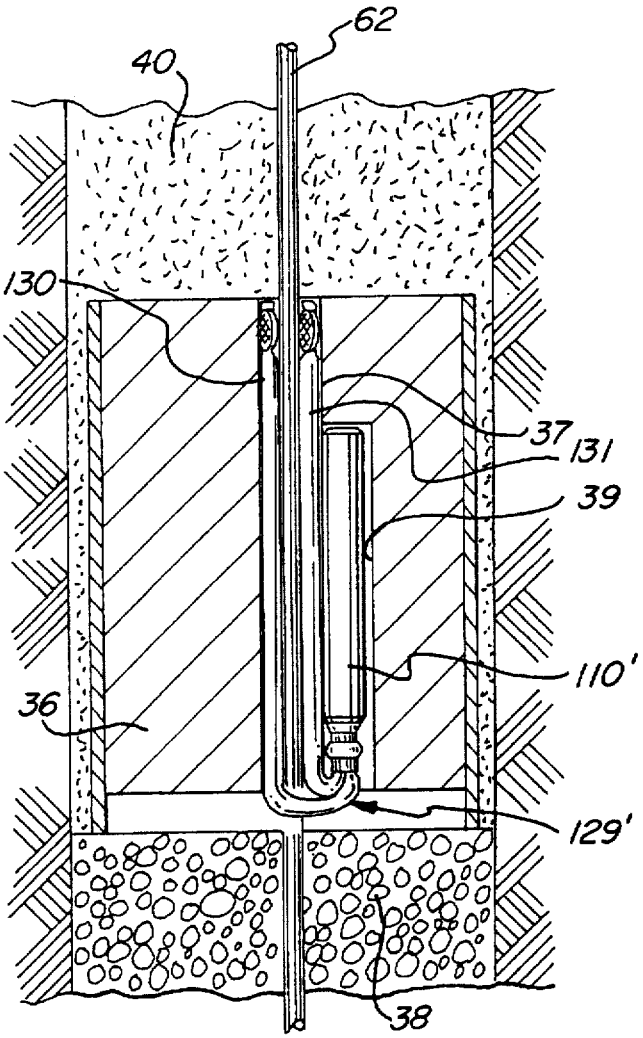
FIG. 4A is a view identical to that of FIG. 4 but reduced in size relative thereto and showing a detonator in accordance with another embodiment of the invention.

FIG. 4A shows the same environment as FIG. 4 with identical parts of FIG. 4A identically numbered as in FIG. 4 and not further described herein. In FIG. 4A detonator 110' has an input lead 129' which comprises signal transmission strand lines 130, 131 extending therefrom through downline well 37 parallel to and in contact with detonating cord 62. Although only two signal transmission strand lines are shown in FIG. 4A, three or four could easily be used, e.g., by employing the detonator 10*c* of FIG. 3A as detonator 110' of FIG. 4A. It will be appreciated that a very large surface area of contact is attained between input lead 129' (or input lead 29*a* of FIG. 2A or input lead 29*c* of FIG. 3A) and detonating cord 62 which greatly enhances reliability of signal transfer to the input lead by the detonating cord. FIG. 5 shows a perspective view of the bottom of a slider unit useful for holding a detonator in place within a booster charge in the type of arrangement schematically illustrated in FIG. 4, the slider unit of FIG. 5 being greatly enlarged relative to FIG. 4. Slider unit 44 is adapted for use with a booster charge of the type which is encased within an outer shell which has means thereon such as recesses located at the bottom of the booster charge which are engaged by protrusions 64 to mount slider unit 44 and a detonator carried thereon within a booster charge, as more fully disclosed in commonly owned co-pending patent application Ser. No. 08/575,224, filed on Jan. 16, 1996, now U.S. Pat. No. 5,661,256 in the name of Daniel P. Sutula, Jr. et al for "Slider Member for Booster Explosive Charges". Slider unit 44 comprises a shielding tube 46 having an internal bore through which the downhole detonating cord passes. Shielding tube 46 not only facilitates sliding of the booster charge along the detonating cord 62, but also serves to protect the booster charge 36 from being damaged as discussed above or initiated directly from the downline detonating cord, which preferably is a low energy detonating cord. If booster charge 36 were to be initiated directly by detonating cord 62, it would disrupt the timing sequence provided by the predetermined delay period provided when detonator 110 is, as is usually the case, a delay detonator. Premature detonation of the booster charge 36 will, as will be appreciated by those skilled in the art, have an extremely adverse effect on the effectiveness of the blasting operation.

A detonator retainer 48 is carried in parallel relation with shielding tube 46, to hold a detonator such as any one of the detonators illustrated and/or described herein. Slider unit 44 also includes a base fixture comprising a base plate 50, line-retaining means 52, and a hinged cover 54 attached to base plate 50 by a hinge 54*a*. FIG. 5 shows hinged cover 54 in the open position; when the slider unit is closed by swinging cover 54 about hinge 54*a*, cover 54 and base plate 50 cooperate to define an enclosed base chamber 51 within which at least a portion of the input lead of the detonator is disposed. Base plate 50 and cover 54 each define an aperture 58*a*, 58*b*, respectively, and these apertures align with one another when cover 54 is closed over base plate 50, and together provide a passage through which detonating cord 62 (FIG. 4) may pass through the base fixture. Within the base chamber 51 formed when cover 54 is closed over base plate 50, the line-retaining means 52 keep the multiple input lines of the input lead of the retained detonator in signal transmission relation with the detonating cord, as will be described more fully below.

Figure 5A:
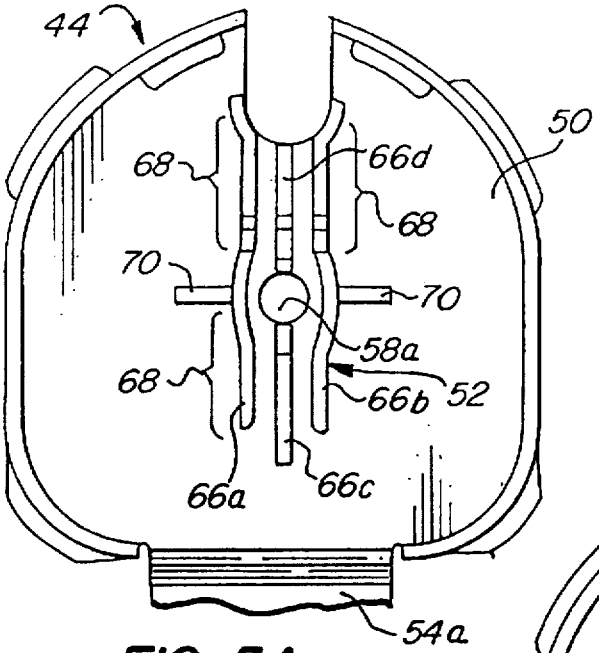
FIG. 5A is a plan view of the base plate of the slider unit of FIG. 5.

As seen schematically in FIG. 5A, line-retaining means 52 comprises flanges 66*a*, 66*b*, 66*c* and 66*d* which are dimensioned and configured to define retaining channels to receive the lines of an input lead from a detonator secured in slider unit 44. On opposite sides of aperture 58*a*, flanges 66*a* and 66*b* define "pinch" regions 68 where the input leads are disposed too close to one another to allow a typical detonating cord to pass between them. Between the pinch regions 68, flanges 66*a* and 66*b* diverge slightly around aperture 58*a* in a deflection region to permit input lines to deflect around a detonating cord passing through aperture 58*a*.

Figure 5B:
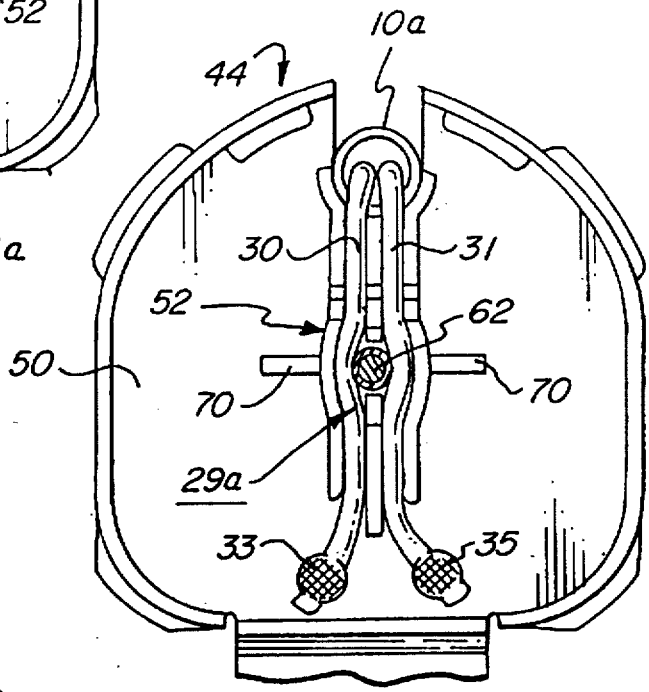
FIG. 5B is a view similar to FIG. 5A, showing the input lead of the detonator of FIG. 2A in place on the base plate.

As seen in FIG. 5B, when the detonator 10*a* of FIG. 2A is in place and signal transmission input lines 30 and 31 are disposed in line-retaining means 52, pinch regions 68 constrain lines 30 and 31 to closely bend around a detonating cord 62 passed through aperture 58*a*. By causing the input lines to closely conform to and bend around the detonating cord 62, the surface area of contact between the cord 62 and the lines 30, 31 of the input lead is increased, thus increasing the reliability with which an initiation signal is transmitted from detonating cord 62 to the input lead. Preferably, flanges 66*a*, 66*b* do not bear on lines 30, 31 in the deflection region even when lines 30, 31 are deflected about a detonating cord, i.e., they are disposed at a slight stand-off from the input lines in the deflection region. Such a stand-off helps the input lead engagement means to avoid imposing firm contact between the input lines and the detonating cord due to foreseeable variations in the diameters of the input lines and the detonating cord. The inherent resilience of the input lines and the slight stand-off of flanges 66*a*, 66*b* allows them to engage in casual abutting contact with the detonating cord in the deflection region. However, flanges 66*a*, 66*b* are configured to constrain lines 30, 31 from deflecting away from the detonating cord to a significant degree when the detonating cord initiated, since this could result in a failure to transfer the initiation signal to the input lines. Gussetts 70 reinforce flanges 66*a*, 66*b* against the lateral force of initiation of the detonating cord at the point of wherein lines 30, 31 contact detonating cord 62, and thus enhance the reliability of signal transfer to the input lead.

Figure 5C:
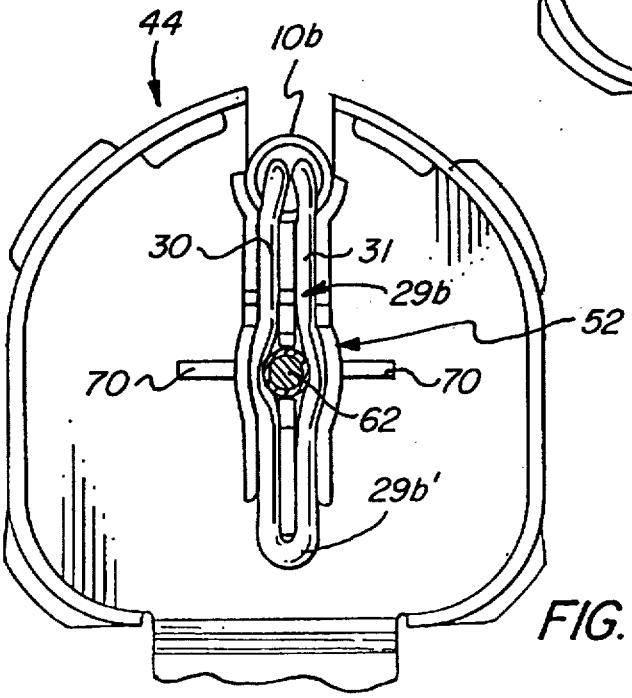
FIG. 5C is a view similar to FIG. 5B showing the input lead of the detonator of FIG. 2B in place on the base plate.

FIG. 5C shows detonator 10*b* of FIG. 2B mounted within slider unit 44 with the bight portion 29*b'* circumscribing aperture 58*a* to provide extended contact between input lead 29*b* and detonating cord 62.

Despite the close, conforming contact of the input lead to the detonating cord 62, the arrangements shown in FIGS. 5B and 5C provide for a smooth sliding contact between the input lead and detonating cord 62 so that sliding movement of booster charge 36 (FIG. 4A) relative to detonating cord 62 is facilitated, the weight of booster charge 36 being more than ample to overcome the frictional resistance between detonating cord 62 and the input lead disposed in contact therewith. Other arrangements of the input lead about the line-retaining means 52 may be employed including a pretzel-like configuration which provides two passes of the signal transmission lines of the input lead adjacent to detonating cord 62 as illustrated in FIG. 5C plus a third pass crossing transversely to the first two passes adjacent detonating cord 62. Such arrangements are shown and described in detail in the aforesaid co-pending patent application Ser. No. 08/548,813, filed on Jan. 11, 1996.

The bore of shielding tube bore 46 is preferably larger in diameter than aperture 58*a* in base fixture 48, and it preferably tapers down to the diameter of aperture 48 to facilitate threading a detonating cord through the slider device. Further, it is preferred that the detonating cord have an oval cross-sectional configuration having a major flattened peripheral arc that extends along the major axis of the oval. The input lead for the detonator preferably bears against the major flattened peripheral arc of the detonating cord. Even more preferably, each input line may also have such a major flattened peripheral arc, for increased sensitivity, and the major flattened peripheral arc of the input line is in contact with the detonating cord. Preferred configurations for contact between the input lead and the detonating cord are described in co-pending patent application Ser. No. 08/548,813, filed on Jan. 11, 1996 in the name of Daniel P. sutula, Jr. et al for "Method and Apparatus for Transfer of Initiation Signals".

Those skilled in the art will, upon a reading and understanding of the foregoing disclosure, appreciate that modifications may be made to slider unit 44 and line-retaining means 52 to accommodate various embodiments of the input leads in accordance with the present invention, including those illustrated in the Figures.

While the invention has been described in detail with reference to particular embodiments thereof, it will be apparent that upon a reading and understanding of the foregoing, numerous alterations to the described embodiments will occur to those skilled in the art and it is intended to include such alterations within the scope of the appended claims. For example, although the multiple-line input leads illustrated herein are short relative to the length of the detonator, the mulitple-line input leads may, as noted above, be quite long, up to many hundreds of meters in length, for connection of the input lead of a detonator to an initiator which is remote from, e.g., many hundreds of meters from, the detonator.

What is claimed is:

1. A detonator having an output section and comprising:

a shell defining an enclosure;

a target charge comprising at least an explosive output charge disposed within the shell at the output section of the detonator; and an input lead extending into the detonator and secured therewithin, the input lead having at least two signal transmission input lines which extend into the shell and terminate in signal-emitting ends disposed within the shell in signal transmission relation with the target charge.

2. The detonator of claim 1 wherein the input lead comprises one or more looped input line segments, each comprising a bight portion connecting two legs extending into the shell and terminating in the signal-emitting ends.

3. The detonator of claim 2 wherein the input lead comprises two looped input line segments.

4. The detonator of claim 1 wherein the input lead comprises at least two separate signal transmission strand lines, each line having opposite first and second ends with the first ends of the strand lines comprising the signal-emitting end and being disposed within the shell in signal transmission relation with the target charge and the second end of each strand line being disposed exteriorly of the shell.

5. The detonator of claim 4 wherein the input lead comprises shock tube and the second end of the strand line is sealed to seal the shock tube against the elements.

6. The detonator of any one of claims 1 through 4 inclusively wherein the input lead is comprised of shock tube.

7. The detonator of any one of claims 1 through 4 inclusively wherein the target charge further comprises a delay element connecting the input lead and the explosive output charge in initiation signal communication.

8. The detonator of claim 1 further having an input section and wherein the shell has a closed end at the output section of the detonator and an open end sealed by a sealant means and located at the input section of the detonator, and the signal transmission input lines extend into the shell through the open end thereof.

9. A method of initiating a detonator having disposed therein a target charge comprising at least an explosive output charge which is configured to be initiated by an input signal transmitted thereto by a plurality of signal transmission strand lines having signal-emitting ends disposed in signal transmission communication with the target charge, the method comprising transmitting at least two initiation signals to the target charge.

10. The method of claim 9 further comprising transmitting at least four initiation signals to the target charge.

11. The method of claim 9 or claim 10 wherein the target charge further comprises a delay element having a selected delay period and being interposed between the signal-emitting ends of signal transmission input lines and the output charge, and the method comprises transmitting the initiation signal to the delay element and via the delay element to the output charge, whereby travel of the initiation signals between the signal-emitting ends of the input lines and the output charge is delayed by a selected delay period.

12. The method of claim 9 or claim 10 comprising substantially simultaneously transmitting the initiation signals to the target charge.

13. The method of claim 12 wherein the target charge further comprises a delay element having a selected delay period and being interposed between the signal-emitting ends of the signal transmission input lines and the output charge, and the method comprises transmitting the initiation signals to the delay means and via the delay means to the output charge, whereby travel of the initiation signals between the signal-emitting ends of the input lines and the output charge is delayed by a selected delay period.

* * * * *